United States Patent [19]

Schombourg

[11] Patent Number: 4,767,894

[45] Date of Patent: Aug. 30, 1988

[54] LAMINATED INSULATED CABLE HAVING STRIPPABLE LAYERS

[75] Inventor: Jacques Schombourg, Commungy, Switzerland

[73] Assignee: BP Chemicals Limited, London, England

[21] Appl. No.: 905,580

[22] PCT Filed: Dec. 19, 1985

[86] PCT No.: PCT/GB85/00592

§ 371 Date: Aug. 6, 1986

§ 102(e) Date: Aug. 6, 1986

[87] PCT Pub. No.: WO86/03880

PCT Pub. Date: Jul. 3, 1986

[30] Foreign Application Priority Data

Dec. 22, 1984 [GB] United Kingdom ..... 8432608

[51] Int. Cl.[4] ..... H01B 9/02

[52] U.S. Cl. ..... 174/106 SC; 156/51; 156/56; 174/102 SC; 174/105 SC; 174/120 SC; 174/120 SR

[58] Field of Search ..... 174/102 SC, 105 SC, 174/106 SC, 120 SC, 120 R, 120 SR; 428/394, 515, 519; 156/51, 56

[56] References Cited

U.S. PATENT DOCUMENTS

| | | | |
|---|---|---|---|
| 3,484,540 | 12/1969 | Wilson et al. | 174/120 R |
| 3,546,014 | 12/1970 | Nicodemus | 427/118 |
| 3,576,387 | 4/1971 | Derby | 174/36 |
| 3,748,369 | 7/1973 | Durakis et al. | 174/36 |
| 3,962,517 | 6/1976 | Verne | 174/120 SC X |
| 4,008,367 | 2/1977 | Sunderhauf | 174/107 |
| 4,150,193 | 4/1979 | Burns, Jr. | 174/102 SC X |
| 4,226,823 | 10/1980 | Jansson et al. | 174/120 SC X |
| 4,400,580 | 8/1983 | Yamanouchi et al. | 174/102 SC |
| 4,412,938 | 11/1983 | Kakizaki et al. | 174/105 SC X |
| 4,449,014 | 5/1984 | Brezinsky | 174/107 |
| 4,469,538 | 9/1984 | Wade et al. | 174/105 SC |

FOREIGN PATENT DOCUMENTS

| | | | |
|---|---|---|---|
| 76579 | 4/1983 | European Pat. Off. . | |
| 2117247 | 10/1971 | Fed. Rep. of Germany . | |
| 2619046 | 11/1977 | Fed. Rep. of Germany | 174/106 SC |
| 2737487 | 3/1978 | Fed. Rep. of Germany | 174/120 SC |
| 2739572 | 3/1978 | Fed. Rep. of Germany | 174/105 SC |
| 1196502 | 6/1970 | United Kingdom . | |
| 1321243 | 6/1973 | United Kingdom | 174/102 SC |

*Primary Examiner*—Morris H. Nimmo

*Attorney, Agent, or Firm*—Brooks, Haidt, Haffner & Delahunty

[57] ABSTRACT

A laminated construction comprising at least three extruded layers of polymer-based material in which an intermediate layer (4) between a first layer (3) and a second layer (5) is strippably bonded to the first layer (3) and fully bonded to the second layer (5) such that the second layer together with substantially all of the intermediate layer (4) is readily strippable from the first layer (3). In particular, the invention relates to an insulated electrical cable in which such a laminated construction is arranged substantially coaxially about a core conductor (1); the first layer (3) being an inner layer of insulating material, intermediate layer (4) being either of insulating material or of a semi-coductive shielding material and the second layer (5) being an outer layer of a semi-conductive shielding material. Preferably, an additional layer of semi-condutive shielding material is positioned between the core conductor (1) and the first layer (3).

18 Claims, 1 Drawing Sheet

LAMINATED INSULATED CABLE HAVING STRIPPABLE LAYERS

The present invention relates to laminated constructions comprising extruded layers of polymer—based materials having two adjacent layers which are strippably bonded together. In particular, the invention relates to an insulated electric cable comprising at least three layers of polymer—based materials extruded about an electrical conductor, two adjacent layers of the polymer layers being strippably bonded. The construction of insulated electrical conductors, eg wire and cable, is well known in the art. For medium and high voltage applications, the cable generally comprises a central core conductor of one or more metal strands surrounded coaxially by (in sequential order) a semi-conductive polymeric shielding layer, a polymeric primary insulation layer and an outer semi-conductive polymeric shielding layer overlying the insulation. An outer metallic conductor (eg neutral conductor) overlying or embedded in the outer semi-conductive shielding can also be present, eg in the form of braided wires or metal tape. The cable may also be provided with armoured covering and additional layers to provide for example, weather protection or increased mechanical strength. Preferably, the annular surfaces of the polymeric layers are smooth and substantially concentric. Thus, although it is known to use helically wound tape for one or more layers, the layers are preferably formed by extrusion. Layers formed from tape are also generally more expensive to fabricate than extruded layers.

The inner semi-conductive polymeric shielding layer, the polymeric primary insulation layer and the overlying semi-conductive shielding layer of an electric cable form a coaxial laminated structure and can be applied to the metallic conductor using extrusion coating techniques well known in the art. The layers can be applied sequentially using tandem extrusion techniques, or two or more of the layers may be coextruded simultaneously using coextrusion die heads fed by separate extruders. One or more of the layers in the laminated structure can be crosslinked if desired.

Advantageously, for splicing or terminating cables, the outer semi-conductive shielding layer should be relatively easily stripped from the primary insulation layer leaving little or no conductive residue adhering to the primary insulation and without damaging the surface of the primary insulation. However, the outer semi-conductive shielding layer should be sufficiently bonded to the primary insulation so that the two layers do not separate during installation and conventional use and so that the ingress of contaminants, such as air or water, between the layers is avoided.

Combinations of primary insulating materials and semi-conductive shielding materials having the desired mutual adhesion/stripping characteristics have been developed and are used commercially. However, such laminated combinations of materials as have been developed in the prior art suffer from the disadvantage that they generally require the use of a semi-conductive material having a relatively high cost and/or poor physical, chemical or mechanical properties.

For example, if the semi-conductive shielding layer used is relatively hard, it is often quite difficult to strip it from the primary insulation and a hand tool may have to be used to cut through the semi-conductive shielding layer to the primary insulation in order to facilitate removal. The use of such a tool to cut through the semi-conductive shielding layer may cause damage to the outer surface of the primary insulation. If the semi-conductive shielding layer is relatively soft, it may tend to tear as it is being stripped from the primary insulation.

It is an object of the present invention to provide an improved laminated construction having two adjacent layers which are strippably bonded together A further object of the invention is to provide an improved laminated construction comprising cable insulation having a strippable semi-conductive shielding layer which construction overcomes or at least mitigates the problems of known cable insulation.

Thus according to the present invention a laminated construction comprises at least three extruded layers of polymer-based material characterised in that an intermediate layer between a first layer and a second layer is strippably bonded to the first layer and fully bonded to the second layer such that the second layer together with substantially all of the intermediate layer is readily strippable from the first layer.

A preferred embodiment of the invention provides an insulated cable comprising an electrical core conductor and extruded, substantially coaxially, about the conductor a laminated construction comprising at least three layers of polymer-based material characterised in that the first layer is an inner layer and is a layer of insulating material, the intermediate layer is a layer of a semi-conductive shielding material or an insulating material and the second layer is an outer layer of a semi-conductive shielding material, the intermediate layer being strippably bonded to the first layer and fully bonded to the second layer such that the outer semi-conductive shielding material together with substantially all of the intermediate layer is readily strippable from the insulating material The insulated cable preferably further comprises an additional layer of a semi-conductive shielding material between the electrical core conductor and the first layer of insulating material By "fully bonded" is meant throughout this specification that the relevant layers are incapable of being cleanly peeled apart by manual means. By "strippably bonded" is meant throughout this specification that the relevant layers are capable of being cleanly peeled apart by manual means. "Manual means" includes the use of conventional hand tools The terms "inner layer" and "outer layer" as used In this specification in relation to an insulated cable define the relative position of the layer with respect to the electrical core conductor; "inner" means closer to the core conductor and "outer" means further from the core conductor.

In the preferred embodiment of the present invention the insulating material of the first layer is generally selected from well known primary insulating materials comprising for example, polyethylene, polyethylene copolymers, EPR or EPDM, which material is preferably crosslinked.

The layer which comprises the outer layer of semi-conductive shielding in the preferred embodiment (i.e. the second layer) is preferably crosslinked and can be fabricated from any suitable polymeric composition which is capable of being fully bonded to the intermediate layer. Examples of polymers suitable for use in making the second layer are low density polyethylene, linear low density polyethylene, ethylene/vinyl acetate copolymer, ethylene/ethyl acrylate copolymer, high density polyethylene, EPDM and blends of these materials.

As indicated hereinabove, the first layer of insulating material and second layer of semi-conductive shielding are preferably made from crosslinkable materials. Thus, the polymer based materials which are prepared for use as the first and/or second layers are, for example, peroxide crosslinkable compositions comprising the base polymer, and a peroxide crosslinking agent. Suitable polymers for the first and/or second layer also include silyl modified polymers which are crosslinkable by treatment with water/silanol condensation catalyst. Silyl modified polymers include, for example, copolymers of ethylene with unsaturated silane compounds; graft polymers prepared by grafting unsaturated hydrolysable silane compounds onto polyethylene or other suitable polymers; or polymers which have hydrolysable groups introduced therein by transesterification. In the case that the polymer composition used in fabricating the first and/or second layer comprises a silyl modified polymer, the composition preferably comprises a suitable quantity of silanol condensation catalyst. When it is desired to use a silyl modified polymer, this can be generated in situ in an extrusion process, for example using the well-known Monosil process wherein the base polymer is fed to the extruder with a composition comprising a peroxide grafting initiator, a hydrolysable unsaturated silane and a silanol condensation catalyst.

Preferably, the same method of crosslinking is used for each layer so that only one crosslinking step is required e.g. all the layers are peroxide crosslinked or all silane crosslinked.

To render the composition for the second layer semiconductive, it is necessary to include in the composition an electrically conductive material. The employment of carbon black in semi-conductive shielding compositions is well known in the art and any such carbon black in any suitable form can be employed in the present invention including furnace blacks and acetylene blacks.

The intermediate layer employed in the present invention can be either a semi-conductive layer or an insulating layer. It is an essential feature of the present invention that the material of the intermediate layer is selected so that it is capable of fully bonding to the second layer but forms a strippable bond with the first layer. Accordingly the selection of a suitable material for the intermediate layer is dependent primarily on the nature of the first and second layers, and to a minor extent on the process whereby the cable is fabricated.

Polymeric compositions having the desirable strippability characteristics suitable for fabrication of the intermediate layer are, for example, ethylene/vinyl acetate copolymer, ethylene/ethyl acrylate copolymer,acrylonitrile rubbers, alloys of above mentioned polymers or blends of these copolymers with low density polyethylene or linear low density polyethylene.

A composition which has been found to be particularly suitable for use as the intermediate layer is a blend comprising ethylene/vinyl acetate copolymer and acrylonitrile rubber. Preferably, the vinyl acetate content of such a composition is at least 28% by weight based on the total weight of ethylene/vinyl acetate copolymer and acrylonitrile rubber and preferably is from 30 to 45% by weight. If the intermediate layer is required to be semi-conductive, it is necessary to include in the composition an electrically conductive material such as, for example, a carbon black. Such semi-conductive compositions are commercially available e.g. the materials sold by BP Chemicals under the trade names BPH 310ES and BPH 315ES However, it is a feature of the present invention that the layer which is strippabiy bonded to the insulation layer in an electric cable need not be a semi-conductive material. Suitable compositions for use as the intermediate layer which are not semi-conductive are also commercially available e.g. the ethylene/vinyl acetate copolymers; EVATENE sold by ICI/ATO, LEVAPREN sold by Bayer & Co, OREVAC sold by ATO and ESCORENE sold by Esso Chemicals. EVATENE, LEVAPREN, OREVAC and ESCORENE are trade marks. The polymer-based material used as the intermediate layer may be crosslinkable The materials for the various layers may be readily selected from known materials such as those given, but trial and error experiments may be required to ensure that the selected materials provide the required adhesive forces for any particular application.

Preferably the polymer compositions forming the layers are selected so that after fabrication into cable (including any crosslinking step) the force required to strip the second layer together with substantially all of the intermediate layer from the first layer lies in the range 0.5 to 8 kgs per 1 cm strip as measured by the French Standard HN 33-S-23 from Electricite de France (EdF).

French Standard HN 33-S-23 relates to a test for removing the semiconductor shield from an insulating sheath.

The principle of the test comprises measuring the force required to remove the 50 mm of a strip of semiconductor shield from the insulating shield by pulling the strip substantially in the axis of the cable, 180° from its initial position. The test piece, about 150 mm long, is prepared in the follow manner. A strip of the assembly formed by the insulating material and the internal and external semiconductor shields having a length of 150 mm and a width, measured on the side of the external semiconductor shield, of 10 mm is removed from the cable. The strip is obtained merely by cutting with a knife longitudinal generatrices of enough depth to cut the internal semiconductor shield. The external semiconductor shield of the strip is removed by hand before the test over a portion of its length, so as to leave the insulating material and semiconductor shield adhering over 50 mm. In the removed part the insulating material of the cable can if necessary be cut to facilitate being seized in the jaw of the pulling machine. The test temperature are: 0° C., 20° C. and 40° C. The test piece is introduced into the pulling machine, the insulating material of the cable being gripped in one of the jaws of the apparatus and the external semiconductor shield, folded 180° on itself, being gripped in the other jaw. The assembly is installed either in a cold enclosure or in a stove, until the temperature of the sample becomes stabilized at the value specified for the test, with a tolerance of ±2° C. The strip of the semiconductor shield is pulled at a speed of 50 mm/min. The removal force is continuously recorded as a function of the distance apart of the pulling machine jaws. The peak value obtained at the start of the test (maximum value) and the value obtained when conditions have been established are recorded.

The ratio of the thickness of the second layer to the thickness of the intermediate layer is preferably in the range 10:1 to 1:1. For general purpose medium voltage and high voltaga cable, the absolute thickness of the intermediate layer will generally lie in the range 0.01 to 2.0 mm, preferably 0.1 to 0.5 mm. As indicated above, the intermediate layer is preferably crosslinked. However, a relatively thin layer of polymer-based material, as preferred in the present invention, which layer contains a peroxide crosslinking agent may have a tendency to "scorch" i.e. to pre-crosslink. In an embodiment of the present invention, the first and second layers contain a peroxide crosslinking agent, the polymer-based material used as the intermediate layer does not itself contain a peroxide crosslinking agent but is crosslinked by diffusion of crosslinking agent from the first and second layers The insulation layer(s) and the semi -conductive layer(s) can be applied to the cable by conventional means, for example by tandem extrusion or coextrusion techniques. Preferably the first, intermediate and second layers are simultaneously coextruded. Preferably a cable according to the preferred embodiment comprises a metallic core conductor surrounded by an additional layer of semi-conductive shielding, with the first, intermediate and second layers simultaneously co-extruded onto this additional semi-conductive layer.

The preferred additional layer of semi-conductive shielding material between the conductor and the first layer of insulation material can be a conventional matarial Conveniently, the preferred additional layer of semi-conductive shielding material has the same composition as the outer layer (i.e the second layer) of semi-conductive shielding layer.

The insulated cable according to the present invention may have other conventional layers such as for example a neutral conductor, armoured covering and weather protection coatings The cable insulation construction of the present invention provides a variety of advantages over conventional cable insulation. For example it is possible to select a semi-conductive material for the second layer having improved mechanical properties such as better thermal ageing properties, higher heat deformation properties, higher abrasion resistance, less temperature sensitivity in relation to strippability, better resistance to solvents, better impact resistance, less degradation during curing. Furthermore, the second layer can generally be selected from compositions having lower cost than conventional strippable insulation compositions.

The second layer and intermediate layer of the present invention are generally easily strippable from the first layer without tearing. If a conventional cutting tool is used to faciliate the start of the stripping, the cutting edge may be adjusted so that it only cuts through the second layer, thus avoiding damage to the first layer. The invention is further illustrated by reference to the cable constructions shown in the accompanying drawin

BRIEF DESCRIPTION OF THE DRAWINGS

In FIG. 1 a central aluminis conductor 1 is surrounded by sequential layers of semi-conductive shield 2, insulation 3 and tri semi-conducti insolation shield 4.

DESCRIPTION OF THE PREFERRED EMBODIMENT

Figure 2:
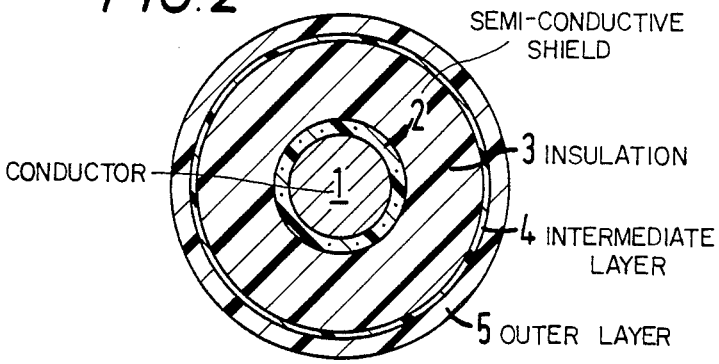

In FIG. 2 is similar central aluminium conductor 1 is surrounded by sequential layers comprising the preferred additional layer of semi-conductive shielding material 2, the first layer 3 which is an inner layer of insulation material 3, the intermediate layer 4 which may be a semi-conductive layer or an insulating layer and the second layer 5 which is an outer layer of semi-conductive shielding material. The intermediate layer 4 is strippably bonded to the first layer 3 and fully bonded to the second layer 5 such that a second layer 5 together with intermediate layer 4 can be cleanly peeled from the insulation layer 3 by manual means. The layers 2, 3, 4 and 5 can be extruded using known techniques. The four layers can be extruded using four separate extruders in tandem. Alternatively two or more layers may be co-extruded. For example, a "double" die head fed by two separate extruders may be used to extrude the first two layers 2,3 and then a second "double" die head fed by a further two extruders may be used to extrude the outer two layers 4 and 5. A preferred process for producing the cable shown in FIG. 2 comprises extruding the preferred additional semi-conductive layer 2 about the conductor 1 using a first extruder and then co-extruding the other three layers using a "triple" die head fed by three separate extruders and curing the cable in a conventional gas curing line.

The invention is illustrated by the following Examples:

Comparative Test Cable

Figure 1:
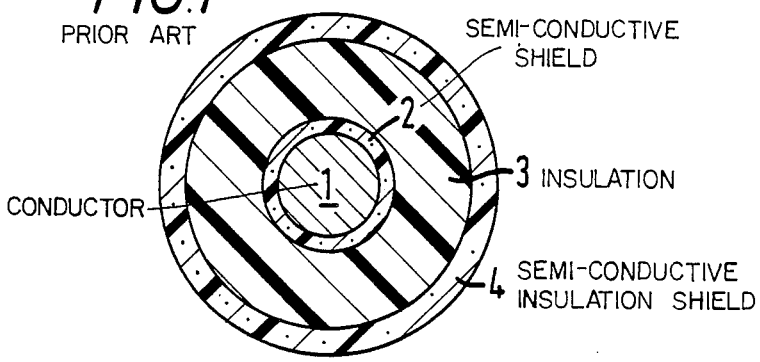
FIG.1 PRIOR ART
FIG. 1 the drawings illustrates in cross-section a conventional medium voltage power cable and FIG. 2 illustrates in similar cross-section a medium voltage power cable in accordance with the present invention.

A medium voltage power cable designed for a rated voltage of 12 kV and having a cross section similar to that depicted in FIG. 1 was extruded and cured on a conventional gas curing line. The layers were extruded on to the aluminium conductor using a tandem technique wherein the inner layer 2 of semi-conductive material was extruded from a single die head and the layers 3 and 4 were coextruded in line from a "double" die head fed by two extruders.

The thicknesses of the layers are recorded in Table 1. The temperature profile of the gas heating zone is shown in Table 2. The compositions of the materials employed to form the layers are set out below.

EXAMPLE 1

A medium voltage power cable (design rating 12 kV) in accordance with the present invention and having a cross-section similar to that depicted in FIG. 2 of the drawings was extruded and cured on a conventional gas curing line. The layers were extruded on to the aluminium conductor using a tandem technique wherein the inner layer 2 of semi-conductive material and the first layer 3 of insulating material were coextruded in line from a "double" die head fed by two extruders and then the intermediate layer 4 and the second layer 5 of semi-conductive shielding material were coextruded in line from a second "double" die head fed by two extruders. The thicknesses of the layers are recorded in Table 1. The temperature profile of the gas heating zone is shown in Table 2. The compositions of the materials employed to form the layers are set out below.

Composition of Layers

(a) Semi-conductive Material

A commercially available compound sold by BP Chemicals under the trade name HFDM 0595 Black was employed as the semi-conductive material for layer 2 in the Comparative Cable and layers 2 and 5 in Example 1 and had the following composition:

EEA copolymer—61.22 parts by weight
Carbon black (P grade)—37.78 parts by weight
Antioxidant (DQA)—0.4 parts by weight
Peroxide curing agent—0.9 parts by weight The EEA copolymer was an ethylene/ethyl acrylate copolymer manufactured by the free radical catalysed high pressure polymerisation method. It had an ethyl acrylate content of about 18 weight percent, a melt index of about 6 and a density of 0.93.

DQA is dihydrotrimethyl quinoline.

(b) Insulation Material

The insulation material employed as layer 3 in both the Comparative Cable and Example 1 is a commercially available material sold by BP Chemicals under the trade designation HFDM 4201 and had the following composition.

LDPE—97.92 parts by weight
Antioxidant—0.18 part by weight Peroxide curing agent (dicumyl peroxide—1.9 parts by weight.

The LDPE was low density polyethylene having a melt index of 2.0 and a density of 0.92 manufactured by the high pressure free radical catalysed process.

(c) Strippable Semi-conductive Material

The strippable semi-conductive material employed as layer 4 in both the Comparative Cable and Example 1 is a commercailly available product sold by BP Chemicals under the trade name BPH 315ES Black comprising an ethylene/vinyl acetate copolymer containing 45 wt% of vinyl acetate and having a density of 0.985 and a Mooney viscosity of 20 (ML4'-100° C.), acrylonitrile rubber, carbon black, a peroxide curing agent and conventional additives.

TABLE 1

| | Comparative Cable | Example 1 |
|---|---|---|
| Cross sectional area of aluminium core (1) | 50 $mm^2$ | 50 $mm^2$ |
| Thickness of layer 2 (Conductor shield) | 0.5 mm | 0.5 mm |
| Thickness of layer 3 (First layer comprising insulation) | 3.5 mm | 3.5 mm |
| Thickness of layer 4 (Layer strippable from layer 3) | 0.8 mm | 0.1 mm |
| Thickness of layer 5 (Second layer fully bonded to layer 4) | — | 0.7 mm |

TABLE 2

| Zone | length (m) | Temperature (°C.) Comparative Cable | Example 1 |
|---|---|---|---|
| 1 | 10 | 450 | 450 |
| 2 | 10 | 380 | 450 |
| 3 | 10 | 370 | 450 |
| 4 | 10 | 360 | 400 |
| 5 | 10 | 340 | 400 |
| 6 | 10 | 300 | 400 |

In view of the higher heat degradation resistance of the outer layer 5 of the cable according to the present invention (Example 1) compared with layer 4 of the Comparative Cable it was possible to use a higher temperature cuting profile and hence a higher line speed Comparative Cable line speed—10.5 meters/minute
Example 1 line speed—15.0 meters/minute

TABLE 3

| Cable evaluation on insulation shield | | | | |
|---|---|---|---|---|
| Property | Unit | Test Method | Comparison Cable | Example 1 |
| Ultimate tensile strength | MPa | ASTM D 638 | 125 | 176 |
| After 10 days at 150° C. in oven, % retained | % | ASTM D 638 | 65 | 98 |
| Elongation at break | % | ASTM D 638 | 350 | 385 |
| After 10 days at 150° C. in oven % retained | % | ASTM D 638 | 35 | 85 |
| Shore D hardness at 23° C. | % | ISO R 868 | 30 | 48 |
| Vicat softening point | °C. | ISO R 306 | 65 | 94 |
| Abrasion test | mg | DIN 53515 | 135 | 65 |
| Temperature sensitive to strip | °C. | — | 40 max. | no limit |

EXAMPLES 2 TO 5

The manufacture of electrical cable insulation was modelled by preparing laminated plaques. Sheets of the insulation material (first layer) were prepared by moulding 60 g of prerolled material in a cavity mould measuring 230 mm×200 mm×2 mm. The mould was placed in a press preheated to a temperature of from 120° C. to 125° C. After three minutes at a relatively low pressure of from 20 to 50 bar (2 to $5\times10^6$ Pa), the pressure was increased to 250 ($25x\ 10^6$ Pa) bar and after a further 2 minutes, the mould was cooled at a rate of approximately 40° C./min. at the same pressure. This method of preparing the moulded sheet did not cross-link the insulating material Sheets of non-crosslinked semi-conductive shielding material (intermediate layer) and sheets of non-crosslinked semi-conductive outer layer (second layer) were also prepared by moulding under the same conditions. The thickness of the sheets of intermediate layer was 0.2 mm and the thickness of the sheets of the second layer was 0.8 mm.

The insulation material used for the first layer (layer 3 in FIG. 2) was the commercially available product HFDM4201 as described in Example 1. The second layer (layer 5 in FIG. 2) comprised the commercially available product HFDM 0595 Black described in Example 1. Four different materials were used to prepare the intermediate layers (layer 4 in FIG. 2) BPH 315 ES, BPH 310 ES, Evatene 33/25 and Levapren 450. Each of these materials are commercially available products based on stabilised EVA copolymers. BPH 315 ES is described in Example 1 and BPH 310 comprises the same components but in different proportions. Both products are sold by BP Chemicals. Evatene and Levapren contain no peroxide crosslinking agent. Evatene was sold by ICI and is now sold by ATO. Levapren 450 is sold by Bayer & Co. LAVAPREN and EVATENE are trade marks.

Laminated plaques were prepared by placing in a mould a sheet of the insulation material, followed by a sheet of the intermediate layer and finally a sheet of the semi conductive second layer. A strip of a polyester film was placed between the first layer and the intermediate layer along one edge to separate the two layers for a length of approximately 3 cms. The plaques were then cross-linked by first preheating for 3 minutes at 120° to 125° C. at a relatively low pressure of from 20 to 50 bar (2 to $5\times10^6$ Pa), then 2 minutes at a pressure of 100 bar ($10^7$ Pa) followed by heating to 180° C. at 100 bar, maintaining these conditions for 15 mins and then cooling at the same pressure. The cross-linked plaques were then heat treated for 24 hours at 50° C.

Strips lcm wide were cut from the cured plaques in order to determine the force required to strip the second layer (5) together with the intermediate layer (4) from the first layer (3). The polyester film separating the ends of the first and intermediate layers was removed. The free edges of the layers were pulled apart slightly to initiate the stripping. The free ends were mounted in the grips of a tensile testing machine and the stripping force determined according to the French Standard of Electricite de France (Edf) HN 33-S-23 (initial separation between grips 1.5 cms, rate of separation of grips 50 mm minute). The results are given in Table 4. The stripping force between the second layer and the intermediate layer for each combination of materials was also determined in the same manner. The results are also given in Table 4.

TABLE 4

| Example | Layers of Laminate | | | Stripping Force (kg/cm) | |
|---|---|---|---|---|---|
| | Insulation layer (3) | Intermediate layer (4) | Second layer (5) | 4 + 5 from 3 | 5 from 4 |
| 2 | HFDM 4201 | BPH 310 ES | HFDM 0595 | 2.5 | Fully Bonded |
| 3 | HFDM 4201 | BPH 315 ES | HFDM 0595 | 1.2 | Fully Bonded |
| 4 | HFDM 4201 | EVATENE 33/25 | HFDM 0595 | 2.7 | Fully Bonded |
| 5 | HFDM 4201 | LEVAPREN 450 | HFDM 0595 | 1.4 | Fully Bonded |

The results show that the second layer (5) together with the intermediate layer (4) was readily strippable from the insulation material in each case and that the second layer (5) was "fully bonded" to the intermediate layer (4) and could not be separated therefrom.

The intermediate layers of Examples 4 and 5 did not themselves contain a peroxide crosslinking agent but were cured by diffusion of crosslinking agent from the first layer and second layer, each of which did contain a peroxide crosslinking agent. This method of curing the intermediate layer avoids or at least mitigates the problem of "scorching", i.e. premature crosslinking, arising from high shear of the relatively thin intermediate layer in the die.

I claim:

1. An insulated cable comprising an electrical core conductor (1) and arranged substantially coaxially about the electrical core conductor at least three extruded layers of polymer-based material (3, 4, 5) comprising (a) a first layer (3) which is an inner layer of insulating material, (b) a second layer (5) which is an outerlayer of a semi-conductive shielding material and (c) an intermediate layer (4) between the first layer (3) and the second layer (5) which intermediate layer (4) is strippable bonded to the first layer (3) and fully bonded to second layer (5) such that the second layer (5) together with substantially all of the intermediate layer (4) is readily strippable from the first layer (3), the intermediate layer cleanly peeling from the first layer.

2. An insulated cable as claimed in claim 1 in which an additional layer (2) of semi-conductive shielding material is positioned between the electrical core conductor (1) and the first layer (3).

3. An insulated cable as claimed in claim 1 in which the force required to strip the second layer (5) together with the intermediate layer (4) form the first layer (3) is form 0.5 to 8 kg per cm.

4. An insulated cable as claimed in claim 1 in which the ratio of the thickness of the second layer (5) to the intermediate layer is form 10:1 to 1:1.

5. An insulated cable as claimed in claim 1 in which the thickness of the intermediate layer is from 0.1 to 0.5 mm.

6. An insualted cable as claimed in claim 1 in which the first layer (3) comprises a cross-linked polymer-based material selected form the group consisting of polyethylene, polyethylene copolymer, ethylene-propylene rubber, EPDM rubber and blends thereof, the intermediate layer (4) comprises a cross-linked material selected form ethylene vinyl acetate, ethylene ethyl acrylate, acrylonitrile rubber, blends thereof and blends of one or more with low density polyethylene or linear low density polyhethylene and the second layer (5) being an outer semi-conductive layer comprising an electrically conductive material and a cross-linked polymer-based material selected form linear low density polyethylene, low density polyethylene, ethylene vinyl acetate, ethylene ethyl acrylate, high density polyethylene, EPDM rubber and blends thereof.

7. An insulated cable as claimed in claim 6 in which the intermediate layer (4) contains electrically conductive material.

8. An insulated cable as claimed in claim 6 or claim 7 intermediate layer (4) comprises an ethylene/vinyl acetate copolymer and acrylonitrile rubber, the vinyl acetate content being at least 28% by weight based on the total weight of the ethylene/vinyl acetate copolymer and acrylonitrile rubber and the second layer (5) comprises ethylene/vinyl acetate copolymer or ethylene/ethyl acrylate alone or in admixture with polyethylene, polyethylene copolymer or EPDM rubber.

9. An insulated cable as claimed in claim 1 in which the intermediate layer (4) is of insulating material.

10. An insulated cable as claimed in claim 1 in which the intermediate lyaer (4) is of a semi-conductive shielding material.

11. A process for the production of an insulated cable which cable comprises an electrical core conductor (1) and arranged substantially coaxially about the electrical core conductor at least three layers of polymber-based material (3, 4, 5) comprising an intermediate layer (4) between a first layer (3) and a second layer (5), the intermediate layer (4) being strippably bonded to the first layer (3) and fully bonded to the second layer (5) such that the second layer (5) together with substantially all of the intermediate layer (4) is readily strippable from the first layer (3) the intermediate layer cleanly peeling from the first layer, which method comprises extruding about the electrical core conductor in sequential order (A) a first layer which is an insulating material, (B) an intermediate layer and (C) a second layer (5) which is a semi-conductive shielding material, at least one of the first layer and second layer being a cross-linkable polymeric material and containing a curing agent, and then curing the cable.

12. A process for the production of an insulated cable as claimed in claim 11 comprising extruding at least three layers of polymer-based material (3, 4, 5) about an electrical conductor (1) the first layer (3) and second layer (5) containing a peroxide crosslinking agent, the intermediate layer of cross-linkable polymeric material containing no peroxide crosslinking agent and then curing the cable such that the intermediate layer (4) is cured by diffusion of peroxide crosslinking agent from the first layer (3) and/or the second layer (5).

13. A process as claimed in claim 11 in which the intermediate layer is of insulating material.

14. process as claimed in claim 11 in which the intermediate layer is of semi-conductive shielding material.

15. A process as claimed in claim 11 in which an additional layer of semi-conductive shielding material is extruded about the electrical core conductor before the first layer (3).

16. A process as claimed in claim 11 in which the first layer (3) comprises a cross-linked polymer-based material selected from the group consisting of polyethylene, polyethylene copolymer, ethylene-propylene rubber, EPDM rubber and blends thereof, the intermediate layer (4) comprises a cross-linked material selected form ethylene vinyl acetate, ethylene ethyl acrylate, acrylonitrile rubber, blends thereof and blends of one or ore with low density polyethylene or linear low density polyethylene and the second layer (5) being an outer semi-conductive layer comprising an electrically conductive material and a cross-linked polymer-based material selected from linear low density polyethylene, low density polyethylene, ethylene vinyl acetate, ethylene ethyl acrylate, high density polyethylene, EPDM rubber and blends thereof.

17. A process as claimed in claim 11 in which the intermediate layer contains an electrically conductive material.

18. A process as claimed in claim 16 or claim 17 in which the intermediate layer (4) comprises an ethylene/vinyl acetate polymer and acrylonitrile rubber, the vinyl acetate content being at least 28% by weight based on the total weight of the ethylene/vinyl acetate copolymer and acrylontrile rubber and the escond layer (5) comprises ethylene/vinyl acetate copolymer or ethylene/ethyl acrylate alone or in admixture with polyethylene, polyethylene copolymer or EPDM rubber.

* * * * *

UNITED STATES PATENT AND TRADEMARK OFFICE

CERTIFICATE OF CORRECTION

PATENT NO. : 4,767,894

DATED : August 30, 1988

INVENTOR(S) : Jacques Schombourg

It is certified that error appears in the above-identified patent and that said Letters Patent is hereby corrected as shown below:

On the Title Page, in the Abstract, 1. 13, "semi-coductive" should read --semi-conductive--

Col. 1, 1. 12, after "bonded." the next sentence should begin a new paragraph

Col. 2, 1. 37, there should be a "." at end of sentence

Col. 2, 1. 41, there should be a "." at end of sentence

Col. 2, 1. 49, should read --in this specification--

Col. 3, 1. 6, "polymer based" should read --polymer-based--

Col. 4, 1. 14, should have a "." at end of sentence

Col. 4, 1. 36 "follow manner" should read --following manner--

Col. 5, 1. 13, there should be a "." at end of sentence

Col. 5, 1. 27, "matarial Conveniently"should read -material. Conveniently--

Col. 5, 1. 35, there should be a "." at end of sentence

Col. 5, 1. 55, "drawin" should read --drawings.--

Col. 5, 1. 58, "Fig. 1 the drawings" should read -Fig. 1 of the drawings-

Col. 5, 1. 62,"aluminis" should read --aluminium--

Col. 5, 1. 64, "tri semi-conducti insolation" should read --strippable semi-conductive insulation--

Col. 6, 1. 7, after "shielding material." the next line should be a new paragraph Col. 7, 1. 21, "Peroxide curing agent" should read the next line down as a separate item Col. 7, 1. 22, "(dicumyl peroxide" should read -(dicumyl peroxide)-

UNITED STATES PATENT AND TRADEMARK OFFICE

CERTIFICATE OF CORRECTION

PATENT NO. : 4,767,894

DATED : August 30, 1988

INVENTOR(S) : Jacques Schombourg

It is certified that error appears in the above-identified patent and that said Letters Patent is hereby corrected as shown below:

Col. 9, l. 7, there should be a space between "l" and "cm"

Claim 1, l. 10, "strippable" should read --strippably--

Claim 3, l. 4, "form" should read --from--

Claim 11, l. 4, "polymber-based" should read -- polymer-based--

Claim 14, l. 1, "14. process" should read --14. A process--

Claim 16, l. 8, "of one or ore" should read --of one or more--

Claim 18, l. 6, "es-" should read --se--

Signed and Sealed this

Twenty-first Day of March, 1989

*Attest:*

DONALD J. QUIGG

*Attesting Officer*

*Commissioner of Patents and Trademarks*